US007234336B2

(12) United States Patent
Braun et al.

(10) Patent No.: US 7,234,336 B2
(45) Date of Patent: Jun. 26, 2007

(54) METHOD AND EMBOSSING DIE FOR PRODUCING A BODY STRUCTURAL PART FROM A VAULT-STRUCTURED SHEET METAL

(75) Inventors: Guenter Braun, Fellbach (DE); Juergen Ehrenpfort, Rottenburg (DE); Daniela Frank, Sindelfingen (DE); Martin Gruenbaum, Sindelfingen (DE); Bernd Heim, Holzgerlingen (DE); Dieter Lange, Magstadt (DE); Michael Schwabe, Leonberg (DE)

(73) Assignee: DaimlerChrysler AG, Stuttgart (DE)

( * ) Notice: Subject to any disclaimer, the term of this patent is extended or adjusted under 35 U.S.C. 154(b) by 98 days.

(21) Appl. No.: 10/510,740

(22) PCT Filed: Mar. 14, 2003

(86) PCT No.: PCT/EP03/02673

§ 371 (c)(1),
(2), (4) Date: May 27, 2005

(87) PCT Pub. No.: WO03/084693

PCT Pub. Date: Oct. 16, 2003

(65) Prior Publication Data

US 2007/0000298 A1 Jan. 4, 2007

(30) Foreign Application Priority Data

Apr. 11, 2002 (DE) ..... 102 15 912

(51) Int. Cl.
*B21D 13/10* (2006.01)

(52) U.S. Cl. ..... 72/379.6; 72/414

(58) Field of Classification Search ..... 72/379.6, 72/312, 313, 311, 308, 382, 385, 414, 431, 72/434, 465.1, 466, 466.8, 466.9
See application file for complete search history.

(56) References Cited

U.S. PATENT DOCUMENTS

| | | | | |
|---|---|---|---|---|
| 1,462,475 | A * | 7/1923 | Atkinson | 72/374 |
| 2,510,024 | A * | 5/1950 | Mayer | 72/397 |
| 3,319,452 | A * | 5/1967 | Rethwish et al. | 72/397 |
| 5,333,482 | A * | 8/1994 | Dunlap et al. | 72/307 |

FOREIGN PATENT DOCUMENTS

DE G 94 09 126.9 10/1994

(Continued)

*Primary Examiner*—Derris H. Banks
*Assistant Examiner*—Debra M Wolfe
(74) *Attorney, Agent, or Firm*—Crowell & Moring LLP

(57) ABSTRACT

A method and a tool are provided for producing structural parts from sheet metal which have a vault-structured stiffening zone and adjacent, flat connection zones. The starting point for producing these structural parts is vault-structured blanks which are smoothed in the region of the connection zones in the course of the forming, whereas the vault structure is retained unchanged in the region of the stiffening zone. These structural parts are produced by an embossing tool which has a die and a two-piece punch including of a fixing punch and a forming punch. In the process, the blank is first of all fixed relative to the fixing punch in the region of the vault-structured stiffening zone by a fixing element which is in a leading position with respect to the die. The connection zones are then shaped between the punch and the forming punch.

23 Claims, 4 Drawing Sheets

FOREIGN PATENT DOCUMENTS

| | | | |
|---|---|---|---|
| DE | 44 37 986 | | 4/1996 |
| DE | 199 42 383 | | 3/2001 |
| EP | 0 956 912 | | 11/1999 |
| JP | 63-127715 | U | 8/1988 |
| JP | 5-88713 | U | 12/1993 |
| JP | 2000-135520 | A | 5/2000 |
| JP | 2000-136720 | A | 5/2000 |
| JP | 2000-158051 | A | 6/2000 |
| JP | 2001-1058 | A | 1/2001 |
| WO | WO 01/58615 | | 2/2001 |

* cited by examiner

METHOD AND EMBOSSING DIE FOR PRODUCING A BODY STRUCTURAL PART FROM A VAULT-STRUCTURED SHEET METAL

BACKGROUND AND SUMMARY OF THE INVENTION

The invention relates to a method of producing a structural part from sheet metal, in particular a body sheet, and to an embossing tool for producing such a structural part.

Many structural parts in automobile body construction must fulfill stringent requirements with regard to the inherent stability and bending stiffness. Such structural parts are as a rule produced from sheet and are normally provided with beads for increasing the inherent stability and bending stiffness. However, the beading of the sheets leads to a highly directional stiffness increase: thus, although sheet-metal strips having beads arranged in the longitudinal direction are certainly flexurally rigid in the longitudinal direction, they have only low torsional rigidity and are flexible in the transverse direction. Uniform homogeneous stiffening of the sheets therefore cannot be ensured by embossing such beads.

Stiffening with substantially less directional dependence can be achieved if the sheets—instead of being provided with the beading—are provided with "vault structuring" by bulge forming; this method is described, for example, in DE 44 37 986 A1. In contrast to the conventional forming processes (such as deep drawing for example), in which plasticizing of the sheet takes place during the forming, the sheet is merely folded locally during the vault structuring; this is associated with only a small surface enlargement of the material. The bulge forming is effected in a continuous process, so that entire sheets of material (or band-like regions on them) are provided with the vault structure. To produce body structural parts having increased stiffness, blanks are cut out of these sheets of material, and the desired structural parts are then produced from these blanks by further process steps. Thus, for example, DE 199 42 383 A1 describes a motor vehicle floor which is produced by deep drawing a vault-structured sheet.

However, difficulties occur if body parts of vault-structured sheet are to be connected to other structural parts using conventional joining processes (spot welding, screwed connections, etc.). This is because, on account of the vault structuring of the structural part, it cannot be ensured that the members to be joined meet one another in a planar manner in the connection zones in which the vault-structured structural part is to be joined to other structural parts. In order to be able to ensure controlled, high-strength joining of such structural parts by means of a welding process—or a positive-locking screwed connection—the vault structuring of the structural parts must be removed to the greatest possible extent in the connection zones so that the structural parts in these connection zones can bear in a planar manner on (flat) connecting regions of other adjacent subassemblies.

The object of the invention is to propose a method by means of which vault structures can be smoothed locally. It is also the object of the invention to provide a tool which permits simple and controlled smoothing of a locally limited connection zone on a vault-structured structural part.

This object is achieved according to providing a method of producing a structural part from sheet metal, in particular a body sheet having a stiffening zone in which the structural part is provided with vault structuring which increases the stiffness, and having a connecting zone which is more or less free of vault structures, a vault-structured cut-to-size sheet being used as a blank for producing the structural part, said method comprising the following method steps: placing the blank into an embossing tool having a punch and a die; lowering the die with the blank being fixed relative to the punch in a region of the vault-structured stiffening zone by a fixing element which is in a leading position with respect to the die; and further lowering of the die to shape, the connection zone between the punch and die.

This object is also achieved according to the invention by providing an embossing tool for producing a structural part having a vault-structured stiffening zone and a connection zone largely free of vault structures, starting from a blank of vault-structured sheet, the embossing tool having a punch and a die, wherein the die has a leading fixing element for fixing the blank in the tool and also has a basic die body, wherein the punch of the embossing tool is of multi-piece design and comprises a fixing punch interacting with the fixing element of the die, and a forming punch displaceable with respect to the fixing punch, and wherein the basic die body and the forming punch are provided with interacting smoothing regions for embossing the connection zone on the structural part.

Accordingly, in order to produce the desired structural part, a structural-part blank, i.e. a suitably shaped vault-structured sheet-metal section, is formed in an embossing tool comprising a punch and a die. The embossing tool is designed in such a way that the vault structuring originally present on the structural-part blank is not affected in the region of the stiffening zones, whereas the vault structure is smoothed in the connection zones. In order to achieve this, the punch of the embossing tool is of multi-piece design: the punch comprises a fixing punch which is arranged in a region of the punch corresponding to the stiffening zone of the structural part and whose function—in interaction with the leading fixing element on the die—is to fix the blank in the tool without deforming it. Furthermore, the punch comprises a forming punch which is displaceable relative to the fixing punch and is arranged in the region of the punch corresponding to the connection zone of the structural part and whose function—in interaction with a part of the die facing this forming region—is to smooth the sheet locally in the connection zone.

To produce the structural part, first of all, the fixing punch of the embossing tool is raised, and the structural-part blank is put onto the fixing punch in the desired orientation; by lowering the die of the embossing tool, the blank is then clamped in place relative to the punch in the region of the stiffening zone by the leading fixing element of the die; the position of the blank in the tool is therefore fixed. The die is then lowered further, in the course of which the connection zones are formed between the forming regions, corresponding to one another, on punch and die.

Smoothed connection zones in which the vault structure is mostly removed can therefore be produced on the vault-structured blank by means of the embossing tool according to the invention. In these connection zones, the structural parts can be connected to connection parts in following production steps with the aid of conventional joining processes—for example by spot welding or seam welding during the body-in-white stage or by screwed connections during assembly. In the process, the vault structure of the stiffening zones is retained without being deformed. Therefore structural parts which are provided in selected stiffening zones with a (more or less directional) vault structure, but have a more or less smooth surface structure in adjacent connection zones, can be reproduced by means of the embossing tool according to the invention.

In an advantageous configuration of the invention, the end face of the fixing punch is provided with a surface contour which corresponds to the vault structuring of the blank. This has the advantage of helping to orient and position the blank in the tool in a defined manner when the blank is put into the embossing tool, this orientation and position corresponding to the surface structure of the fixing punch. In this way, in particular, the vault structure of the sheet can be oriented in a highly precise manner relative to the forming regions of the embossing tool, so that the smoothed connection zone produced in the course of the embossing operation is positioned in a highly precise manner relative to the vault structure of the stiffening zone.

The fixing element, interacting with the fixing punch, of the die is preferably made of an elastic material, in particular rubber. When the fixing element guided in the die is lowered onto the vault-structured surface of the blank to be fixed, the end face of the fixing punch elastically adapts itself to the vault structure; during the further lowering of the die, the fixing element is compressed, as a result of which the fixing force, exerted by the fixing element, on the blank is increased. The blank is therefore clamped in place with high force (and thus in a nonslip manner) between fixing punch and fixing element during the smoothing of the connection zone.

Alternatively, the fixing element may be designed as a spring-mounted slide, the end face of which is provided with a vault structure (complementary to the end face of the fixing punch). In this case, the blank, in the region of the stiffening zone, is clamped in place in a positive-locking manner between fixing element and fixing punch.

In the course of the smoothing of the connection zone, the surface enlargement which has been produced during the vault structuring in the course of the production of the blank must be reduced in a specific manner. In order to avoid fold formation and/or the generation of radiating patterns on the structural part in the process, it is expedient to provide "consumers", which ensure a defined flow of the excess material. Beads which are provided in the connection zone—preferably close to the transition to the stiffening zone—serve as such "consumers". To shape these beads, bead regions are provided in the forming regions of the embossing tool.

The invention is explained in more detail below with reference to an exemplary embodiment shown in the drawings.

BRIEF DESCRIPTION OF THE DRAWINGS

FIG. 2*b* showing the fixing of the blank in the embossing tool by means of leading fixing elements; and FIG. 2*c* showing a closed embossing tool with finished structural part;

FIG. 3*b* showing a two-piece punch.

DETAILED DESCRIPTION OF THE DRAWINGS

Figure 1A:
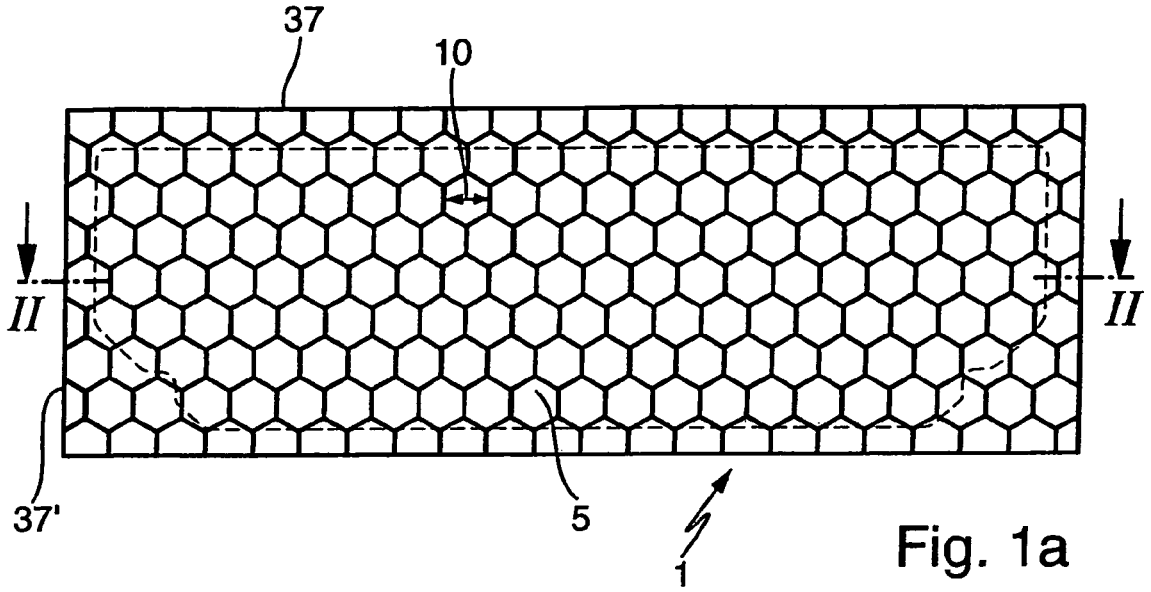
FIG. 1*a* shows a vault-structured blank.
Figure 1B:
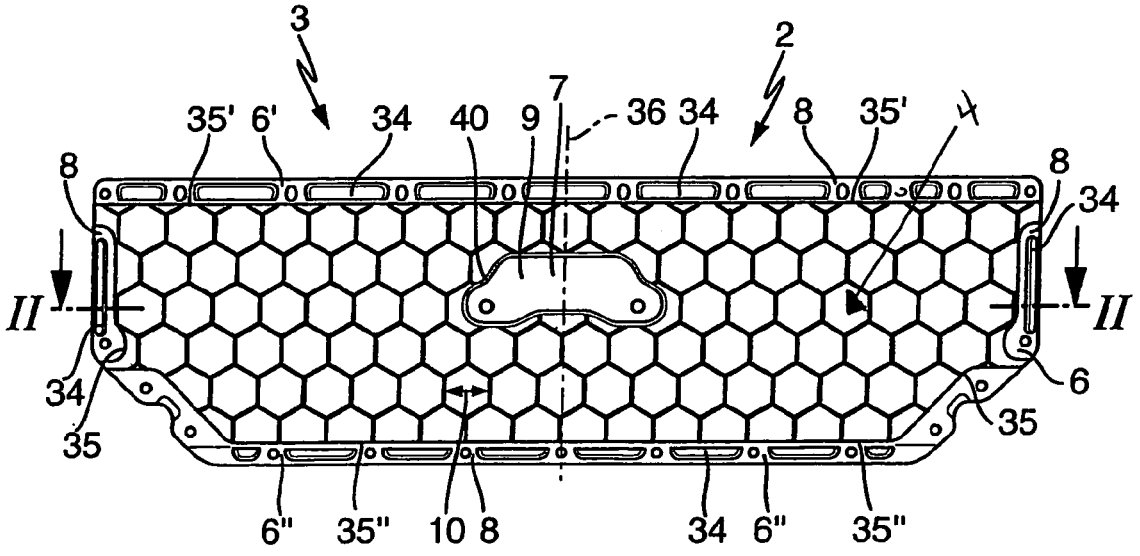
FIG. 1*b* shows a structural part produced from the blank of FIG. 1*a;*

FIG. 1*a* shows a blank 1 of vault-structured sheet, from which a structural part shown in FIG. 1*b*—in the present example a motor-vehicle rear panel 3—is produced by means of the embossing method according to the invention; the outer contour of the structural part 2 is indicated on the blank 1 of FIG. 1*a* by a broken line. The structural part 2 has a vault-structured stiffening zone 4 in which the original vault structuring of the blank 1 is retained; in the marginal regions 6, 6', 6" and in a region 7 lying in the interior of the structural part 2, the latter is provided with connection zones 8, 9 which are largely free of vault structures and are in the form of flat flanges. In the present exemplary embodiment, the vault structure 5 of the blank 1 or of the stiffening zone 4 of the structural part 2 has a hexagonal symmetry, a factor which is indicated schematically in FIGS. 1*a* and 1*b* by a honeycomb pattern. In this case, the grid constant 10 and the vault height of the honeycomb pattern 5 are adapted to the thickness of the structural part 2 and to the desired stiffness increase (or the desired vibration characteristics) of the structural part 2. As an alternative to the hexagonal vault structure 5 shown in FIGS. 1*a* and 1*b*, the blank 1 or the structural part 2 may also have a vault structure having a trigonal or a rectangular base symmetry.

The vault-structured blank 1 is produced from a flat sheet (not shown in the figures) by means of a bulging process, which is described in detail, for example, in DE 44 37 986 A1. Since the vault structure 5 is introduced in a continuous process, the blank 1 has the vault structuring 5 on its entire surface; alternatively, the blank 1 may be provided with vault structuring 5 in one (or more) band-like strips (in accordance with the feed direction of the bulging process), but is free of vault structures in adjacent strips.

The—largely flat—connection zones 8, 9 of the structural part 2, which are produced on the blank 1 using the method according to the invention, serve to connect the structural part to other subassemblies, to which the structural part 2 is attached (in particular welded or screwed) at the body-in-white stage or during assembly.

According to the invention, an embossing method is used for producing the structural part 2 of FIG. 1*b* from the blank 1 of FIG. 1*a*. As an example of an associated embossing device, FIGS. 2*a* to 2*c*, in a schematic, greatly simplified illustration, show a detail of a press 11 which contains a reciprocating press ram 12 and a spatially fixed press table 13. The embossing tool 14 required for forming the blank 1 of the structural part consists of a punch 15 and a die 16. In the present case, the punch 15—as the stationary part—is fastened to the press table 13 and the die 16—as the reciprocating part—is fastened to the press ram 12. Perspective plan views of the die 16 and the punch 15 are shown in FIGS. 3*a* and 3*b*.

The die 16 comprises a basic die body 17, from which two leading fixing elements 18 project. The leading fixing elements 18 are formed by sleeve-shaped rubber sections 19 which are fixed in position by pins 20 which run in the interior of these sleeves 19. The basic die body 17 firstly comprises vault regions 21, the end faces 22 of which have a vault structure 5 corresponding to the blank 1; this vault structuring 5, for better identification, is shown greatly exaggerated in FIGS. 2*a* to 2*c*. Furthermore, the basic die body 17 comprises smoothing regions 23, 24 which have an essentially smooth surface; finally, the basic die body 17 comprises recessed portions 25.

The punch 15 is of two-piece design and consists of a central fixing punch 26 which is surrounded by an annular forming punch 27. The fixing punch 26 has two approximately circular pressure regions 28 and encircling marginal regions 29, the end faces of which are provided with a surface contour 30, 30' which corresponds to the vault-structured contour 5 of the blank 1. The surface contour 30' of the marginal regions 29 of the fixing punch 26 is exactly complementary to the contouring of the vault regions 21 of the basic die body 17, so that, when the press ram 12 is lowered, the die 16 and the punch 15 correspond to one another in a positive-locking manner in these regions 21, 29. The forming punch 27 has a smoothing region 31 which is designed to be complementary to the opposite smoothing region 23 of the die 16. In addition to essentially flat regions, the smoothing regions 23, 31 of the die 16 and the forming punch 27, respectively, have complementary projections 32 and recesses 33, respectively, which serve to emboss beads 34 in the blank 1. As explained below, these beads 34 on the structural part 2 act as "consumers" which receive the excess material accumulating during the embossing process in the connection zones 8.

Figure 2A:
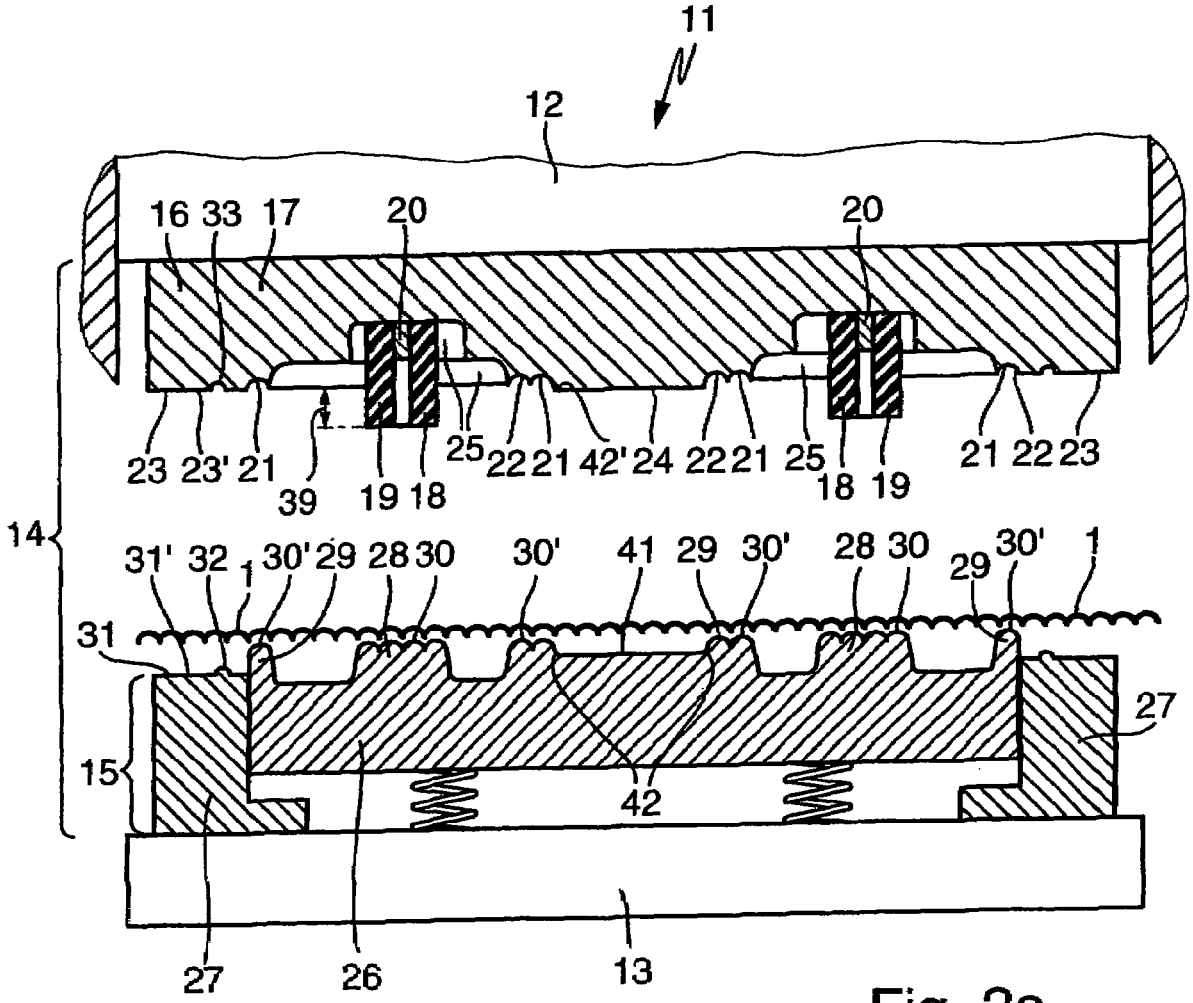
FIGS. 2*a*-2*c* show a sectional view of an embossing tool according to the invention during the production of the structural part with FIG. 2*a* showing an opened embossing tool during the insertion of the blank.
Figure 2B:
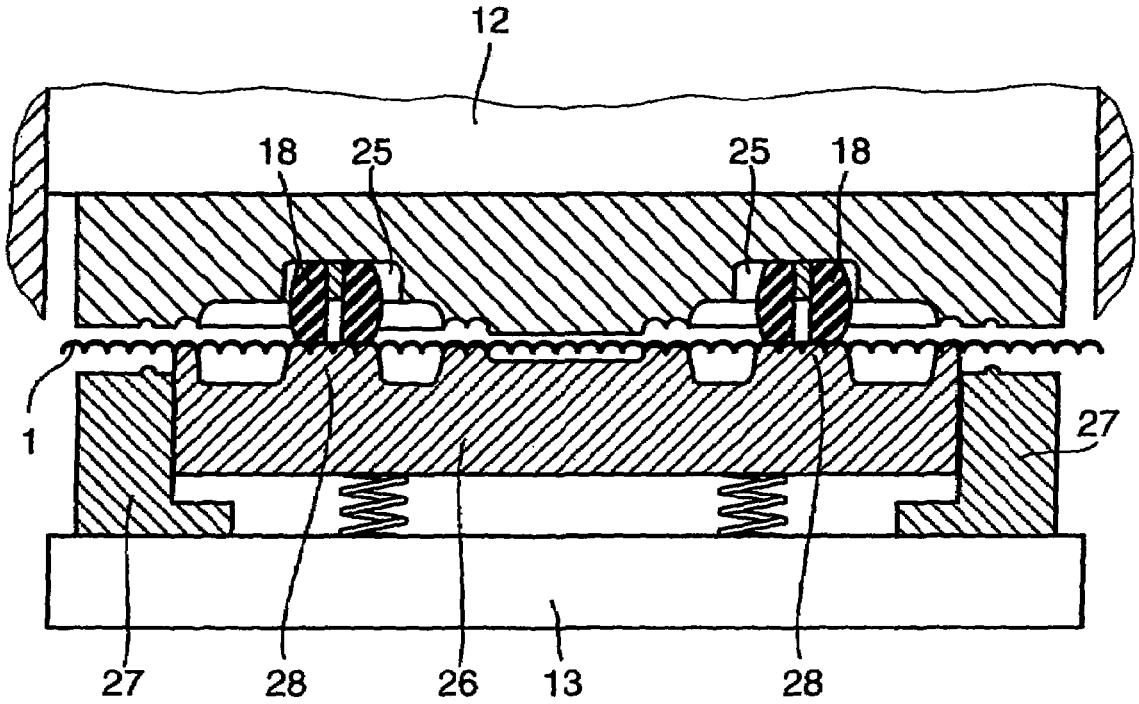
Figure 2C:
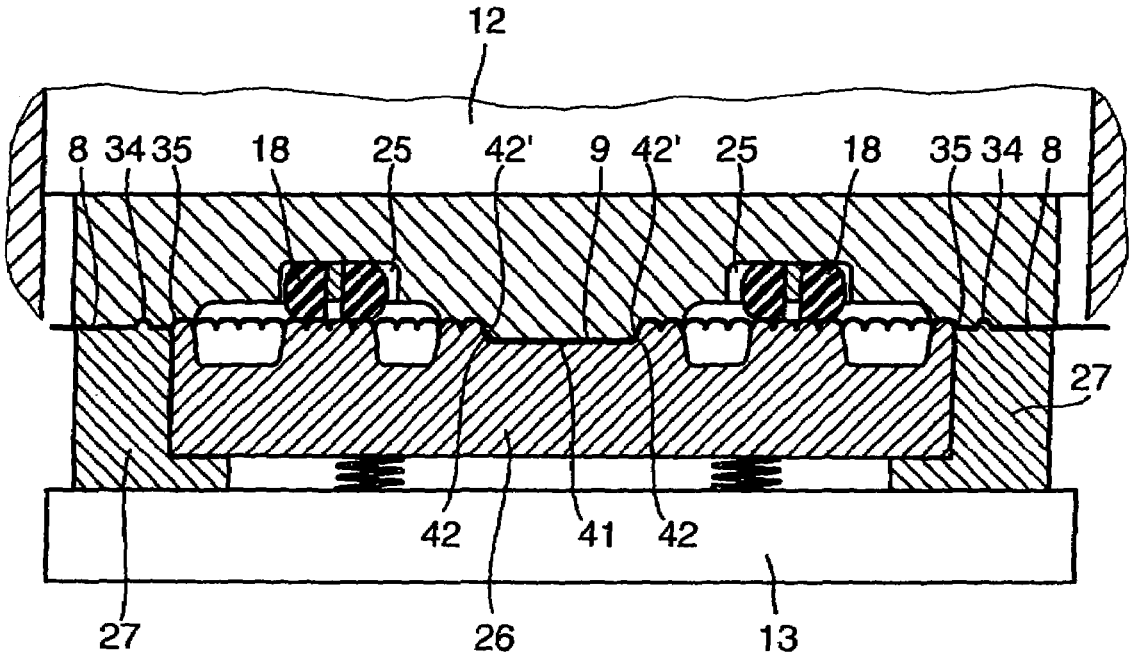
Figure 3A:
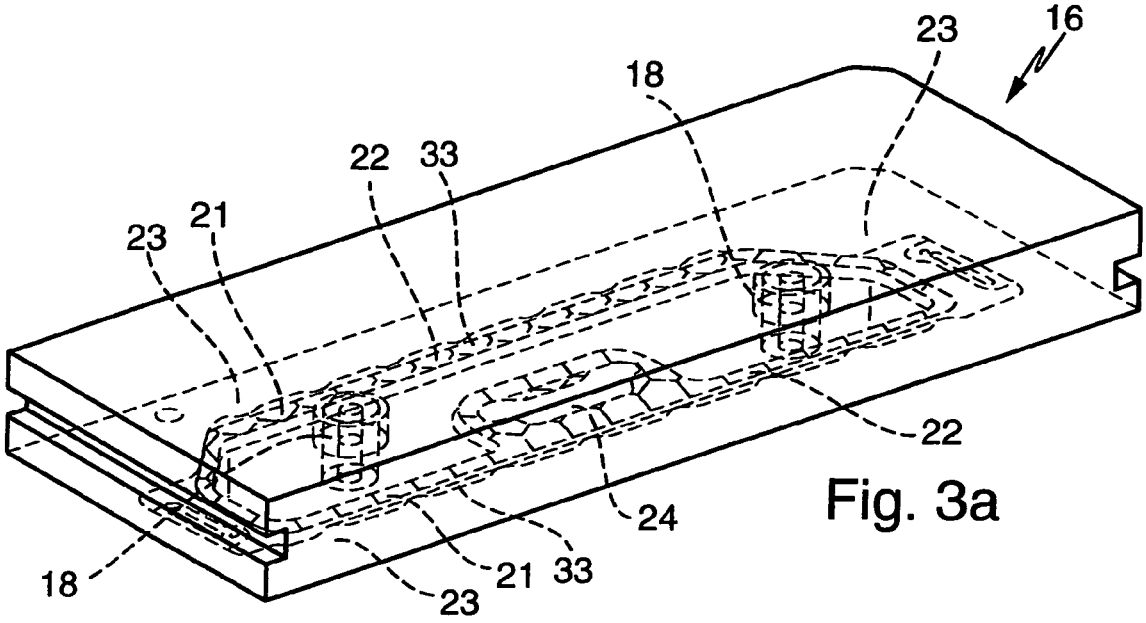
FIGS. 3*a* and 3*b* show a perspective view of an embossing tool according to the invention with FIG. 3*a* shows a die with leading fixing elements.
Figure 3B:
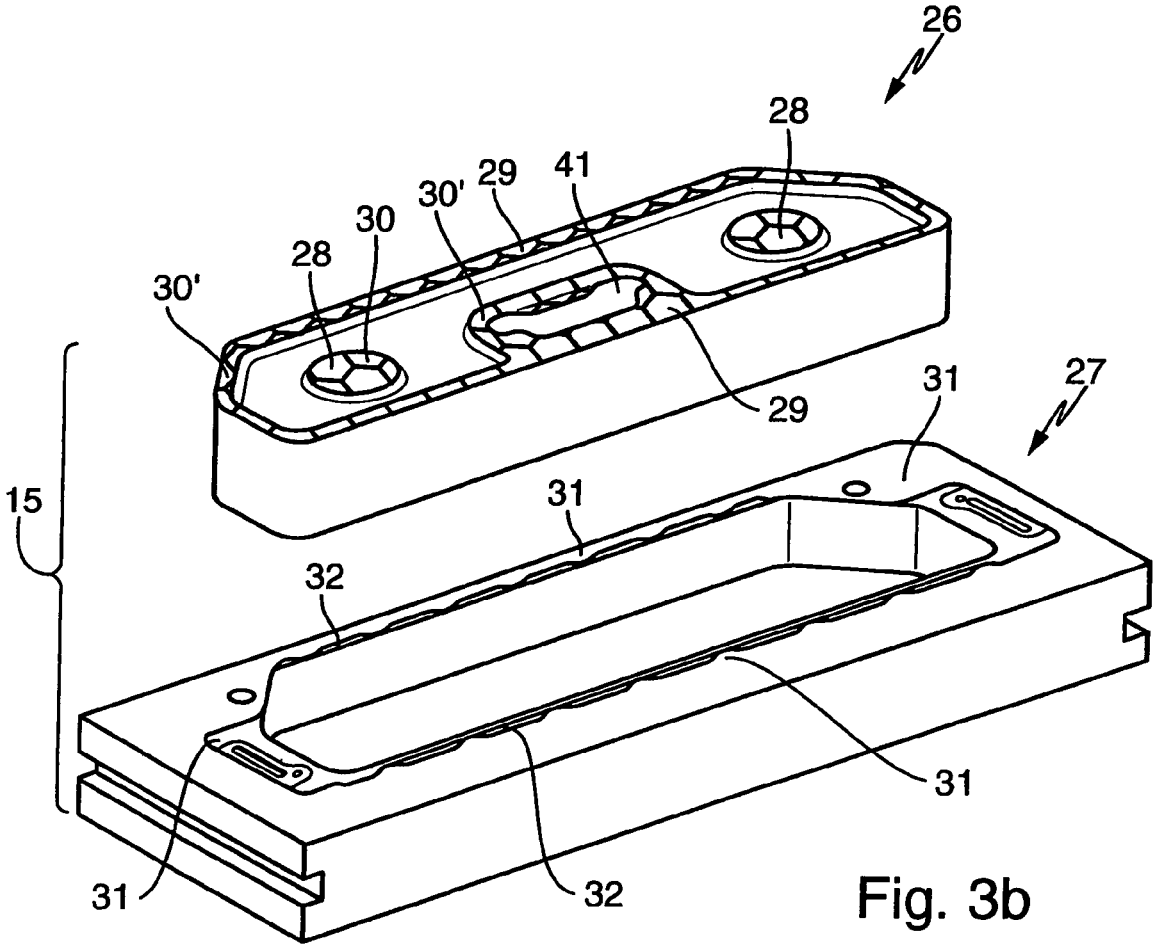

FIGS. 2*a* to 2*c* show a plurality of stages during the production of the structural part 2 by means of the embossing tool 14 according to the invention. FIG. 2*a* shows the opened tool 14 at the start of the embossing process. The blank 1, cut out of a vault-structured semifinished product, of FIG. 1A is put into the pressing tool 14 in such a way that the position and orientation of the vault structure 5 of the blank 1 coincides exactly with the position and orientation of the vault structure 30 provided on the pressure region 28 and the marginal regions 29 of the fixing punch 26. This is important, since (in particular in the transition regions 35 between stiffening zones 4 and connection zones 8) the orientation of the vault structure 5 of the sheet influences the directional stiffness of the structural part 2. In the present case, for example, the vault structure 5 in the stiffening regions 4, as has been determined in the course of numerical strength investigations, should be oriented in such a way that the symmetry axis 36 of the structural part 2—as shown in FIG. 1*b*—coincides with one of the symmetry axes of the hexagonal vault structure 5. Furthermore, the connection zones 8 must be arranged relative to the stiffening zones 4 in such a way that, in the region of the top margin 6', the transition 35' between stiffening zone 4 and connection zone 8 is formed by the serrated margins of the vault-structured pattern 5, whereas, in the region of the bottom margin 6", the transition 35" between stiffening zone 4 and connection zone 8 runs centrally through the hexagons of the vault structure 5. This desired orientation of the vault structure 5 relative to the symmetry axis 36 is predetermined in the embossing tool 14 by the orientation of the vault structure 30, 30' in the fixing punch 26.

The highly precise positioning of the blank 1 relative to the fixing punch 26 can be effected in two different ways: either the blank 1 can be cut to size in such a highly precise manner that selected margins 37, 37' of the blank 1 are positioned and oriented in a highly precise manner relative to the vault structure 5 of the blank 1; thus, for example, the blank 1 of FIG. 1*a* is exactly cut to size in such a way that the margins 37, 37' run exactly through the center points of adjacent honeycombs. In this case, the highly precise positioning of the blank 1 in the fixing punch 26 is effected by means of positioning pins (not shown in the figures), to which the margins 37, 37' of the blank 1 are fastened. This assumes that the blank 1 has been trimmed with the requisite accuracy (as a rule 0.1 mm). As an alternative, or in addition, the blank 1 may be oriented in the fixing punch 26 in such a way that the blank 1, using the force of gravity, is put into the fixing punch 26 in such a way that the vault structure 5 of the blank 1 coincides exactly with the vault structure orientation predetermined by the surface contour 30, 30' of the fixing punch 26. The highly precise orientation of the blank 1 relative to the vault structure 30 of the fixing punch 26 is necessary in order to ensure that the vault structure 5 of the blank 1 in the stiffening zones 4 sustains as little damage as possible during the embossing process, so that this stiffening zone 4 can be retained as far as possible undamaged on the structural part 2.

As shown in FIG. 2*a*, the fixing punch 26 is spring-mounted and—when embossing tool 14 is opened—arranged in a leading manner relative to the forming punch 27. Thus, when the embossing tool 14 is opened, the forming punch 27 with the projections 32 provided in the smoothing region 31 is arranged vertically offset from the fixing punch 26, so that the leading fixing punch 26, in this tool position, presents vault-structured regions 28, 29 to the blank 1, which can be put onto said regions 28, 29 in a clearly defined position and orientation.

If the blank 1—as indicated in FIG. 2*a*—has been put into the embossing tool 14 in the desired position and orientation, the press ram 12 is lowered (see FIG. 2*b*). In the process, first of all the leading fixing elements 18 make contact with the blank 1. During the further lowering of the press ram 12, the blank 1 is clamped in place between the leading fixing elements 18 of the die 16 and the pressure regions 28, facing them, of the fixing punch 26. This clamping in place ensures that the blank 1 does not slip during the embossing operation now following, but is fixed in the desired position and orientation in the embossing tool 14.

During the further lowering of the press ram 12, the press pressure acting on the fixing elements 18 compresses the fixing elements 18, which leads to additional exertion of pressure on the blank 1—and thus to improved fixing in the tool 14. The arching of the elastomeric fixing elements 18 which occurs in the process is not prevented due to the clearance space 25 of the regions of the die 16 which are adjacent to the fixing elements 18. The hardness or the leading distance 39 of the fixing elements 18 is dimensioned in such a way that a certain desired retaining force is exerted on the blank 1 by the fixing elements 18 when the actual embossing process starts. The configuration, shown in FIGS. 2*a* to 2*c*, of the fixing punch 18 as a rubber spring has the advantage that the elastic material of the fixing punch 18 can compensate for tolerances in the vault structure 5 of the blank 1 or inaccuracies during the insertion of the blank 1: due to lateral yielding of the rubber material, the blank 1 can at the same time be pressed by the fixing element 18 into the vault structure 30 of the opposite pressure regions 28 on the fixing punch 26. Alternatively, the fixing element 18 may be formed by a gas compression spring, the end face of which is provided with vault structuring complementary to the pressure regions 28. Furthermore, if need be, a rubber mat can be put underneath between the pressure region 28 and the blank 1 for tolerance compensation.

If the press ram 12 is lowered to such an extent that the vault regions 21 of the die 16 touch the blank 1, the blank 1 is also clamped in place in these regions between die 16 and fixing punch 26. Further feed of the press ram 12 now leads to the spring-mounted fixing punch 26 being forced back together with the blank 1 clamped in place. In the process, the blank 1 clamped in place is pressed onto the forming punch 27 surrounding the fixing punch 26, as a result of which the lateral connection zones 8 and the beads 34 provided in these regions are shaped on the blank 1; the central connection zone 9 is shaped at the same time. To emboss these connection zones 8, 9 and the beads 34, the press ram 12 is lowered to the bottom dead center. During this embossing process, the fixing punch 26 serves as a hold-down, which in the transition regions 35 allows a defined material flow from the adjacent stiffening zone 4 into the connection zone 8.

The shaping of the connection zone 8 is associated with a redistribution of the material present in these regions: in particular, the surface enlargement produced in the course of the vault structuring must be deliberately consumed in order to avoid the generation of folds or radiating patterns on the structural part 2. This is achieved by the beads 34, which lead to a specific material flow, give the structural part 2 good dimensional stability and prevent the generation of long-wave bulge structures (so-called "frogs") on the structural part 2. In this case, the exact position, height, width and orientation of the beads 34 is expediently determined in a simulation of the embossing process, this simulation explicitly taking into account the expansion characteristics of the material used, the properties of the honeycomb structure, etc. The beads 34 are matched to one another in such a way that the long-wave bulge structures on the structural part 2 are avoided.

An encircling bead 40 is also provided at the margin in the connection zone 9 provided centrally in the stiffening zone 4, which encircling bead 40 serves as a consumer and on the one hand prevents a fold formation in the smoothed connection zone 9 and on the other hand avoids radiating patterns leading into the stiffening zone 4. To shape this bead 40, the smoothing region 41, corresponding to the connection zone 9, on the fixing punch 26 is sunk relative to the surface-contoured marginal region 29 surrounding it, so that a step 42 (corresponding to a consumer) is provided on the fixing punch 26 at this point. A step 42' of complementary design is provided on the basic die body 17.

After completion of the embossing process, the formed blank 1 is laser-trimmed in order to obtain the structural part 2 of FIG. 1*b*. Alternatively, the trimming after the embossing operation may be effected by means of a cutting tool.

The method according to the invention is suitable in particular for producing structural parts 2 of aluminium sheet, but can also be used for forming blanks 1 made of any materials capable of being deep drawn.

The invention claimed is:

1. A method of producing a structural part from sheet metal, in particular a body sheet having a stiffening zone in which the structural part is provided with vault structuring which increases the stiffness, and having a connection zone which is more or less free of vault structures, a vault-structured cut-to-size sheet being used as a blank for producing the structural part, said method comprising:

placing the blank into an embossing tool having a die, a resiliently mounted fixing punch engageable with a part of the blank, and a stationary forming punch engageable with another part of the blank;

lowering the die with the blank being fixed relative to the fixing punch in a region of the vault-structured stiffening zone by a fixing element which is in a leading position with respect to the die; and further lowering of the die to shape the connection zone between the forming punch and die.

2. The method as claimed in claim 1, wherein beads are formed in the connection zone in the course of the shaping of the connection zone.

3. An embossing tool for producing a structural part having a vault-structured stiffening zone and a connection zone largely free of vault structures, starting from a blank of vault-structured sheet, the embossing tool having a punch and a die, wherein the die has a leading fixing element for fixing the blank in the tool and also has a basic die body, wherein the punch of the embossing tool is of multi-piece design and comprises a fixing punch interacting with the fixing element of the die, and a forming punch displaceable with respect to the fixing punch, and wherein the basic die body and the forming punch are provided with interacting smoothing regions for embossing the connection zone on the structural part.

4. The embossing tool as claimed in claim 3, wherein the fixing punch has an end face that is provided with a surface contour corresponding to the vault structuring of the blank.

5. The embossing tool as claimed in claim 3, wherein the leading fixing element of the die is made of an elastic material.

6. The embossing tool as claimed in claim 5, wherein the elastic material is rubber.

7. The embossing tool as claimed in claim 4, wherein the leading fixing element of the die is made of an elastic material.

8. The embossing tool as claimed in claim 7, wherein the elastic material is rubber.

9. The embossing tool as claimed in claim 3, wherein the leading fixing element of the die is designed as a spring-mounted slide, the end face of which slide is provided with a vault structure.

10. The embossing tool as claimed in claim 4, wherein the leading fixing element of the die is designed as a spring-mounted slide, the end face of which slide is provided with a vault structure.

11. The embossing tool as claimed in claim 5, wherein the leading fixing element of the die is designed as a spring-mounted slide, the end face of which slide is provided with a vault structure.

12. The embossing tool as claimed in claim 7, wherein the leading fixing element of the die is designed as a spring-mounted slide, the end face of which slide is provided with a vault structure.

13. The embossing tool as claimed in claim 3, wherein the smoothing regions of the die and of the punch comprise bead regions for embossing beads on the structural part.

14. The embossing tool as claimed in claim 4, wherein the smoothing regions of the die and of the punch comprise bead regions for embossing beads on the structural part.

15. The embossing tool as claimed in claim 5, wherein the smoothing regions of the die and of the punch comprise bead regions for embossing beads on the structural part.

16. The embossing tool as claimed in claim 9, wherein the smoothing regions of the die and of the punch comprise bead regions for embossing beads on the structural part.

17. The embossing tool as claimed in claim 7, wherein the smoothing regions of the die and of the punch comprise bead regions for embossing beads on the structural part.

18. The embossing tool as claimed in claim 12, wherein the smoothing regions of the die and of the punch comprise bead regions for embossing beads on the structural part.

19. A method of making a vehicle body structural part from a sheet material blank which has a stiffening zone with vault structuring increasing stiffness of the sheet material, said method comprising:

placing the blank in an embossing tool having a die, a resiliently mounted fixing punch engageable with a part of the blank, and a stationary forming punch engageable with another part of the blank, moving the die and blank toward one another with fixing of a portion of the vault structuring clamped against lateral movement, and further moving the die and blank toward one another to compress a portion of the vault structuring to form a connection zone.

20. The method according to claim 19, wherein said fixing of the portion of the vault structuring against lateral movement includes engaging the sheet material blank with elastic parts of the embossing tool.

21. The method according to claim 19, wherein beads are formed in the connection zone in the course of the shaping of the connection zone.

22. The method according to claim 20, wherein beads are formed in the connection zone in the course of the shaping of the connection zone.

23. An embossing tool for producing a structural part having a vault-structured stiffening zone and a connection zone largely free of vault structures, starting from a blank of vault-structured sheet, comprising:

elastic means for elastically clamping the vault-structured sheet during a first part of relative movement of a die, a resiliently mounted fixing punch engageable with a part of the blank, and a stationary forming punch engageable with another part of the blank toward one another, and smoothing means operable to smooth out connection zones in the vault-structured sheet during further part of said relative movement while said elastic means continue to clamp the sheet without compressing vault-structured stiffening zones thereof.

* * * * *